United States Patent [19]

Speck

[11] Patent Number: 4,558,833

[45] Date of Patent: Dec. 17, 1985

[54] ELECTRICAL CABLE REEL

[76] Inventor: F. James Speck, 440 W. Alco, Centralia, Mo. 65240

[21] Appl. No.: 649,272

[22] Filed: Sep. 10, 1984

[51] Int. Cl.[4] ..... B65H 75/24

[52] U.S. Cl. ..... 242/110.1; 242/72 R

[58] Field of Search ..... 242/110.1, 110.2, 110.3, 242/72 R

[56] References Cited

U.S. PATENT DOCUMENTS

| | | | |
|---|---|---|---|
| 502,373 | 8/1893 | Munslow . | |
| 524,657 | 8/1894 | Van Ormer . | |
| 555,516 | 3/1896 | Knox . | |
| 562,476 | 6/1896 | Miller . | |
| 570,920 | 11/1896 | Faut | 242/110.3 |
| 824,290 | 10/1905 | Eichoff | 242/110.3 |
| 1,054,022 | 2/1913 | Neller . | |
| 1,088,282 | 2/1914 | Hudson | 242/110.3 |
| 1,147,680 | 7/1915 | Crawford . | |
| 1,732,224 | 10/1929 | Danziger . | |
| 1,908,073 | 5/1929 | Spoor et al. . | |
| 2,012,452 | 8/1935 | Littell | 242/110.1 |
| 2,022,091 | 11/1935 | Scharnhorst . | |
| 2,389,644 | 11/1945 | Shibovich . | |
| 3,319,667 | 5/1967 | Folta . | |
| 3,326,495 | 6/1967 | DeBruyn . | |
| 3,799,215 | 3/1974 | Willems . | |
| 3,931,941 | 1/1976 | Hornbuckle . | |
| 3,989,205 | 11/1976 | Jacobszoon . | |
| 4,063,694 | 12/1977 | Lemin . | |
| 4,381,087 | 4/1983 | Williams . | |

FOREIGN PATENT DOCUMENTS

| | | | |
|---|---|---|---|
| 121782 | 9/1926 | Switzerland | 242/110.1 |
| 118893 | 3/1927 | Switzerland | 242/110.1 |

*Primary Examiner*—Stuart S. Levy
*Assistant Examiner*—Lloyd D. Doigan
*Attorney, Agent, or Firm*—Schmidt, Johnson, Hovey & Williams

[57] ABSTRACT

An improved electrical cable reel is provided which quickly and easily loads and unloads a coil of wire. The reel has an outer circular plate coupled to a vertical post for rotation about a horizontal axis. Four spaced, radially movable fingers adjacent the plate simultaneously retract inwardly as the plate is turned to a coil loading position. Once the wire coil is in place, means are provided for selectively releasing the fingers for radially outward movement under the influence of a set of springs. Consequently, the fingers rapidly engage the coil at its inner core. Subsequently, a clutch means may be operated to render the reel rotatable in either direction. The maintenance-free operating structure is safely and conveniently placed out of reach. Advantageously, the reel is mounted on a four wheeled electrical cart containing a measuring device and a wire cutter, such that various coils may be quickly changed for use on the cart.

10 Claims, 7 Drawing Figures

ELECTRICAL CABLE REEL

BACKGROUND OF THE INVENTION

1. Field of the Invention

The present invention relates to a holder for a wire coil having spring-loaded prongs which press against the inside of a coil.

2. Description of the Prior Art

Electricians have wrestled with electrical wire coils virtually since the day wire was first manufactured. These coils, while being both heavy and bulky, must be unwound with care lest the wire twist or kink. Such careful handling, while necessarily frustrating and time-consuming, is mandated by proper wiring procedure.

As an example, copper wire which has become twisted is readily susceptible to fatigue failure during further handling. However, a small gap in the metal will initially be unnoticed, because the wire is usually sheathed with a plastic wrapping. Unfortunately, once the circuit is energized, arcing may occur at the gap, creating a hazardous condition. Consequently, such wire must then be identified and replaced, thereby increasing labor and material costs accordingly.

It has been suggested in the past to mount wire coils on a reel having a plurality of radially adjustable prongs or "fingers", as illustrated in U.S. Pat. Nos. 524,657 and 502,373. However, the fingers are manually secured in position by pins or bolts.

Other wire reels have also been proposed which utilize linkage interconnecting the fingers for radial movement, as seen in U.S. Pat. Nos. 3,931,941 and 1,147,680. These reels have generally proven to be unsatisfactory because the linkages are necessarily exposed, and subject to accidental bending and also to entanglement with the loose end of a wire coil.

The above disadvantages are noticeably amplified at most job sites. Typically, the electrician attaches the coil to a reel which feeds the cable to an adjacent device to measure, straighten and cut the wire. However, in practice, a wide variety of wire sizes are usually specified, and the electrician is forced to often remove the wire from the reel and replace it with a coil of a different size. In such cases, the speed at which the electrician can change the coils becomes critical.

As a result, there remains a decided need in the art for an electrical cable reel which can be simply operated to allow fast changeover of coils, yet be highly effective for a wide variety of wire thicknesses and coil sizes.

SUMMARY OF THE INVENTION

In my present invention I employ an electrical cable reel having spring-loaded fingers, each radially movable in a path adjacent a coil-abutting plate. An operating means interconnects the fingers, the plate and a vertical post rotatably supporting the plate.

The fingers retract inwardly to a coil loading position as the plate is initially rotated. After the wire is placed around the fingers, the operating means is released to allow the spring-loaded fingers to press against the inside of the coil. A clutch means selectively allows the plate to freely rotate in either direction, winding or unwinding the coil, after the wire is placed on the reel.

Accordingly, my electrical cable reel provides a means for quickly and easily securing a coil of wire. In addition, almost all of the moving parts of the reel are safely recessed to avoid entanglement with stray wire ends or human appendages. These advantages can readily be utilized both on new construction and in maintenance work.

DESCRIPTION OF THE PREFERRED EMBODIMENT

Figure 1:
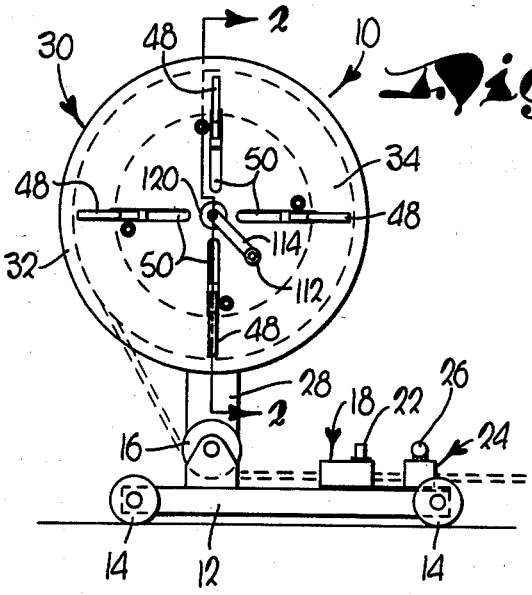
FIG. 1 is a side elevational view of the electrical cable reel made in accordance with the present invention in conjunction with a wire cutter and measuring device.
Figure 3:
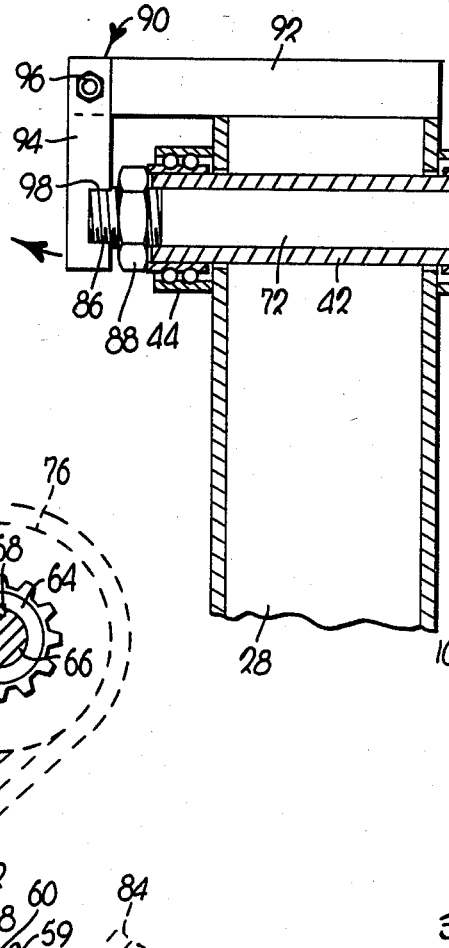
FIG. 3 is a fragmentary, cross-sectional view taken along line 3—3 of FIG. 2.
Figure 2:
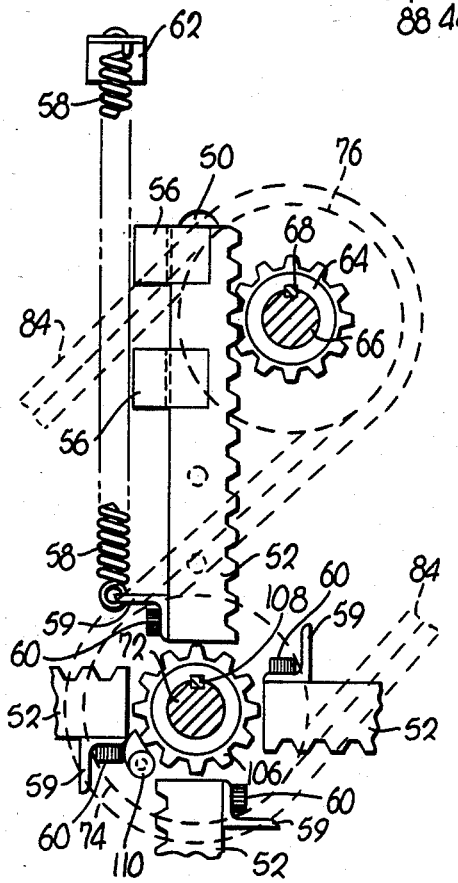
FIG. 2 is an enlarged, cross-sectional view taken along line 2—2 of FIG. 1.
Figure 2:
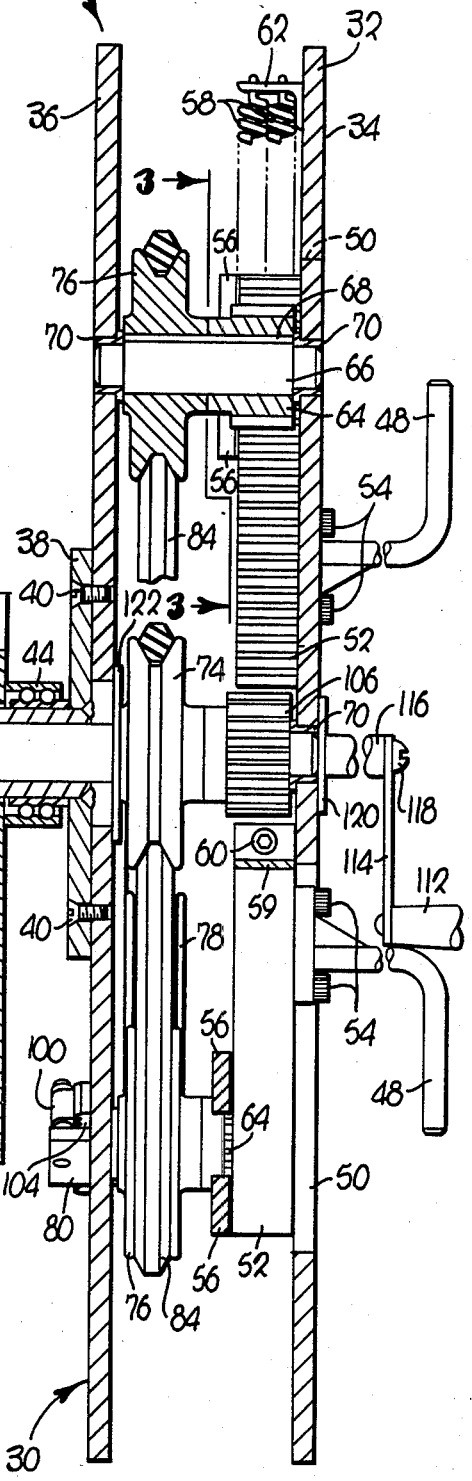

An electrical cable cart 10 has a frame 12 with four wheels 14 mounted thereon. The frame 12 carries a cable guide 16, and also a wire measuring device 18 having a visual indicating counter 20 and a reset switch 22. Additionally, the frame 12 supports a wire cutter 24 having a swingable cutting lever 26.

A hollow, vertical post 28 extends upwardly from the cart 10 and supports an electrical cable reel broadly designated 30. A flat, circular plate 32 is rotatably coupled to the post 28 and presents a coil mounting face 34. Also, a flat circular subplate 36 spaced from the plate 32 is connected to a flange 38 by screws 40.

A hollow cylindrical sleeve 42 is fixedly coupled on one end thereof to the flange 38. A pair of ball bearing pillow blocks 44, each attached to the post 28 by a pair of bolts 46, support the sleeve 42 for rotation about a horizontal axis.

Four generally L-shaped fingers 48 are located in spaced relationship to one another adjacent the coil mounting face 34. Each of the fingers 48 extends through a radial, elongated slot 50 in the plate 32 and is connected to a rack gear 52 by means of a pair of fasteners 54. A pair of brackets 56 connected to the plate 32 guide each of the rack gears 52 for slidable, reciprocal movement adjacent the plate 32. A pair of springs 58 are coupled on one end thereof to an angle brace 59 mounted on the rack gear 52 by a screw 60, and are coupled at the opposite end thereof to an angle brace 62 attached near the periphery of the plate 32.

A pinion gear 64 is cooperatively associated with each of the rack gears 52. Each of the pinion gears 64 is mounted on an axle 66 with an anti-rotation key 68 therein. Each of the axles 66 is rotably connected to the plate 32 and the sub-plate 36 therebetween by means of a pair of bushings 70 which render the axle 66 rotatable about a horizontal axis.

A drive means comprises an elongated shaft 72 extending through the sleeve 42, with a drive pulley 74 mounted thereon. A driven pulley 76 is fixed to each of the axles 66 adjacent the pinion gear 64, the anti-rotation key 68 extending therethrough.

An idler pulley 78 is rotatably mounted on an elongated arm 80, the latter pivotally connected to the sub-plate 36 by means of a pin 82. A double V belt 84 interconnects the idler pulley 78, the drive pulley 74 and the four driven pulleys 76.

A threaded portion 86 on the shaft 72 remote from the drive pulley 74 extends from one of the pillow blocks 44 and has a nut 88 threadably engaged thereon. A clutch means 90 includes a bar 92 fixedly engaging the upper end of the post 28. A locking member 94 is pivotally connected to the bar 92 by means of a bolt 96, and is selectively engageable with a slot 98 formed within the threaded portion 86 on the shaft 72.

A means for selectively releasing the fingers 48 comprises a lever pawl 100 pivotally connected to an L-shaped portion of the arm 80. The lever pawl 100 is biased by means of a spring 102 toward an elongated toothed member 104 for releasable engagement with the latter.

A rotation-preventing means comprises a gear 106 fastened to the shaft 72 adjacent the drive pulley 74 and affixed by an anti-rotation key 108. A check pawl 110 pivotally mounted on the plate 32 has a portion yieldably biased toward the gear 106 for engagement with the latter.

A hangle 112 is connected to a leg 114, the latter engaged against a tubular extension 116. A machine screw 118 couples the leg 114 to the extension 116, and extends through the latter into an end of the shaft 72 remote from the threaded portion 86. A small washer 120 and a large washer 122 align the plate 32 and the subplate 36 to the shaft 72.

OPERATION

In use, the locking member 94 first is moved to a position to engage the slot 98, securing the shaft 72. Next, the arm 80 is moved to the full-line position shown in FIG. 4 such that the idler pulley 78 tightens the belt 84 against the drive pulley 74 and the driven pulleys 76. The lever pawl 100 is released to engage the toothed member 104 to hold the idler pulley 78 in said belt-tightening position.

Next, the plate 32 is rotated in a counterclockwise direction, viewing FIG. 1. The belt 84 will then rotate the driven pulleys 76 as the latter travel about the secured drive pulley 74. As a consequence, each of the driven pulleys 76 will simultaneously turn the adjacent pinion gear 64, causing the rack gear 52 to slide radially inward along the brackets 56. Simultaneously, the fingers 48 connected to the rack gears 52 move inwardly toward a coil loading position. The check pawl 110 prevents the springs 58 from urgedly rotating the plate in a reverse, clockwise direction.

Figure 4:
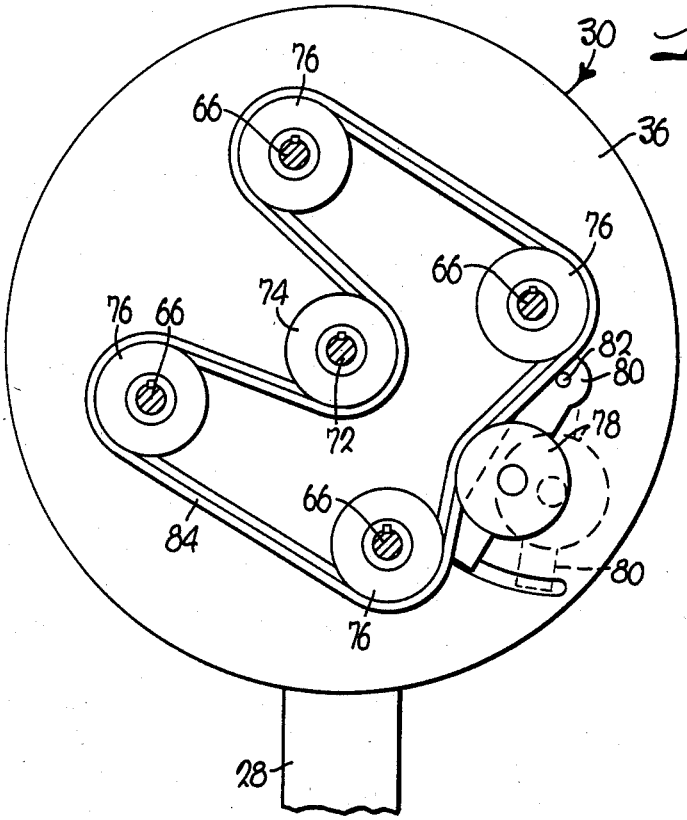
FIG. 4 is a vertical sectional view showing the pulleys, the arm and the belt on the sub-plate.
Figure 5:
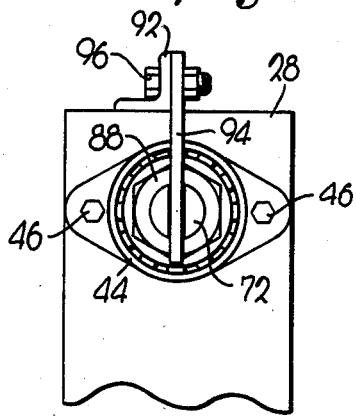
FIG. 5 is a fragmentary view illustrating the lock arm and shaft end.
Figure 6:
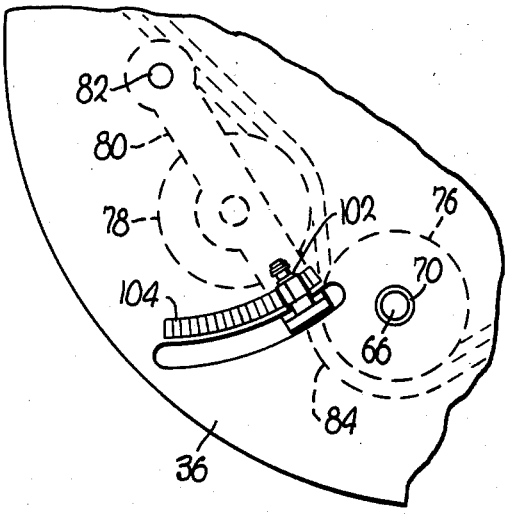
FIG. 6 is a fragmentary view showing the lever pawl and toothed member on the sub-plate.
Figure 7:
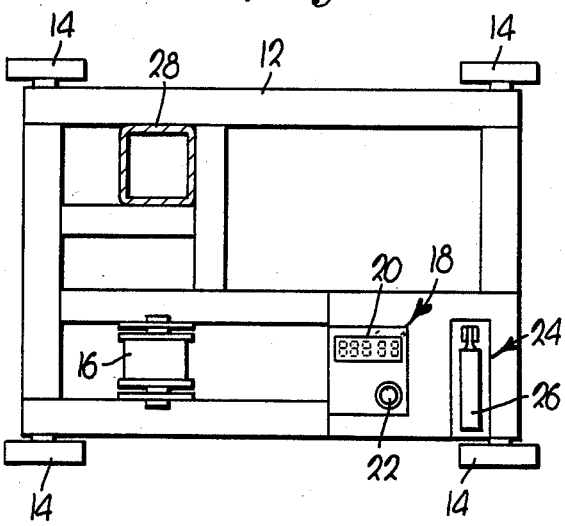
FIG. 7 is an enlarged horizontal sectional view of the cart of FIG. 1.

After the wire coil is mounted around the fingers 48, the lever pawl 100 is disengaged from the toothed member 104, and the arm 80 is moved to the dashed-line position in FIG. 4 such that the belt 84 is slack. As a result, the driven pulleys 76 can now freely rotate, and the springs 58 urge each of the rack gears 52 radially outward to a coil-engaging position.

The locking member 94 is then pivotally moved to disengage the slot 98, allowing the shaft 72 to rotate freely within the sleeve 42. Also, the arm 80 is moved again to a position wherein the idler pulley 78 removes slack in the belt 84, the lever pawl 100 engaged against toothed member 104 to secure the idler pulley 78 in its belt-tightening position.

As shown by the dotted lines in FIG. 1, the electrical wire is subsequently wound about the guide 16, through the measuring device 18 and the cutter 24. The reel 30 is free to rotate in a counterclockwise direction, viewing FIG. 1, as the sleeve 42 and the shaft 72 freely rotate within the bearings 44.

Additionally, the handle 112 may be used to rewind the wire on the reel 30 as the latter is moved in a clockwise direction, viewing FIG. 1. The check pawl 110, engageable with the gear 106, forces the plate 32 and the subplate 36 to simultaneously turn as the handle 112 is turned.

Noteworthy is the fact that the electrical cable reel 30 may quickly be removed from the post 28 by removing the nut 88 and the screws 40. Consequently, another type of wire holding reel, such as a type used with spooled wire coils, may then be quickly inserted within the sleeve 42. Thus, a single cart 10 with a measuring device 18 and a cutter 24 may advantageously be used for a wide variety of electrical work.

Furthermore, almost all of the moving parts of the reel 30 are safely and conveniently recessed between the plate 32 and the subplate 36, thereby reducing hazardous or damaging contact therewith. Yet, the reel 30 may be quickly and simply operated and will require almost no maintenance over extended periods of use.

While the above description has been limited somewhat to reels for electrical cable, it is to be understood that the reel 30 may also be adapted for use to hold almost any other type of item which is manufactured and sold in a coiled configuration. Consequently, such modifications may be made without departing from the term of the appended claims.

I claim:

1. A reel for holding a coil of wire comprising:

a support;

a plate rotatably coupled to the support and presenting a coil mounting face;

a plurality of fingers located in spaced relationship to one another and adjacent said plate face;

operating means for said fingers including structure operatively coupled between the fingers and the plate for radially inward retraction of the fingers to a fixable coil loading position upon rotation of the plate, means yieldably biasing said fingers radially outwardly from said coil loading position, and means for selectively releasing said fingers from said coil loading position when the fingers are in said coil loading position for radially outward movement of the fingers under the influence of said biasing means to a coil-engaging position; and means for preventing rotation of the plate in a direction opposite to the direction of rotation thereof to retract said fingers, said structure comprising a rack gear connected to each of said fingers, a pinion gear cooperatively associated with each of the rack gears, and drive means operatively coupling the pinion gears and the support, said drive means comprising:

a shaft rotatably connected to the support, a drive pulley mounted on said shaft, a driven pulley connected to each of said pinion gears, an arm, means pivotally connecting said arm to the plate, an idler pulley rotatably mounted on the arm, a belt interconnecting all of the pulleys, and clutch means releasably securing the shaft, whereby the fingers are retracted when the clutch means secures the shaft and said plate is rotated.

2. The invention of claim 1, said clutch means comprising a slot on the shaft remote from the drive pulley, and a locking member pivotally connected to the support and selectively engageable with said slot.

3. The invention of claim 2, said rotation-preventing means comprising a gear mounted on the shaft adjacent said drive pulley, and a check pawl cooperatively associated with said shaft-mounted gear.

4. The invention of claim 2; and a sleeve rotatably coupling the support and the plate therebetween, said shaft extending through said sleeve.

5. The invention of claim 4, said means for selectively releasing the fingers comprising a lever pawl connected to said arm, and a toothed member for selective engagement with said lever pawl.

6. The invention of claim 1, said means biasing the fingers radially outward comprising a pair of springs connected to each of the rack gears and the plate.

7. A reel for holding a coil of wire or the like comprising:

a support;

a plate rotatably coupled to the support and presenting a coil mounting face;

a plurality of fingers located in spaced relationship to one another and adjacent said plate face; and operating means for said fingers including structure operatively coupled between the fingers and the plate for radially inward retraction of the fingers to a fixable coil loading position upon rotation of the plate, means yieldably biasing said fingers radially outwardly from said coil loading position, and means for selectively releasing said fingers from said coil loading position when the fingers are in said coil loading position for radially outward movement of the fingers under the influence of said biasing means to a coil-engaging position, said structure incuding a drive pulley coupled to the support, a driven pulley associated with each of said fingers, and a belt interconnecting all of said pulleys, said releasable means including means for selectively relieving tension on said belt, such that operation of said releasable means enables free rotation of said driven pulleys and allows movement of said fingers under the influence of said biasing means to said coil-engaging position.

8. The invention of claim 7, wherein a rack gear is connected to each of said fingers, and a pinion gear cooperatively associated with each of said rack gears is coupled to each of said driven pulleys.

9. The invention of claim 8; wherein a shaft is rotatably connected to said support, and said drive pulley is coupled to said shaft.

10. A reel for holding a coil of wire or the like comprising:

a support;

a plurality of coil-mounting fingers located in spaced relationship to one another and coupled to said support; and operating means for said fingers including structure operatively coupled to said fingers and associated with said support for selective, simultaneous radially inward retraction of all of the fingers to a fixable coil loading position, means yieldably biasing said fingers radially outwardly from said coil loading position, and means for selectively releasing said fingers from said coil loading position when the fingers are in said coil loading position for radially outward movement of the fingers under the influence of said biasing means to a coil-engaging position, said structure incuding a drive pulley coupled to the support, a driven pulley associated with each of said fingers, and a belt interconnecting all of said pulleys, said releasable means including means for selectively relieving tension on said belt, such that operation of said releasable means enables free rotation of said driven pulleys and allows movement of said fingers under the influence of said biasing means to said coil-engaging position.

* * * * *